US006662851B2

(12) United States Patent
Colson

(10) Patent No.: US 6,662,851 B2
(45) Date of Patent: Dec. 16, 2003

(54) LADDER OPERATED COVERING WITH FIXED VANES FOR ARCHITECTURAL OPENINGS

(75) Inventor: Wendell B. Colson, Weston, MA (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/003,097

(22) Filed: Dec. 6, 2001

(65) Prior Publication Data

US 2002/0079066 A1 Jun. 27, 2002

Related U.S. Application Data

(60) Provisional application No. 60/258,158, filed on Dec. 22, 2000, and provisional application No. 60/305,996, filed on Jul. 16, 2001.

(51) Int. Cl.[7] ..... E06B 9/26

(52) U.S. Cl. ..... 160/176.1 R; 160/178.3

(58) Field of Search ..... 160/168.1 R, 176.1 R, 160/178.3 R, 236, 177 R

(56) References Cited

U.S. PATENT DOCUMENTS

| | | | | | |
|---|---|---|---|---|---|
| 723,762 | A | * | 3/1903 | Tumler | 160/168.1 R |
| 1,952,739 | A | | 3/1934 | Weisfeld | |
| 2,105,082 | A | | 1/1938 | Johnson | |
| 2,116,357 | A | | 5/1938 | Laborda et al. | |
| 2,169,873 | A | * | 8/1939 | Clark, Jr. | |
| 2,218,508 | A | | 10/1940 | Gentile | |
| 2,244,094 | A | | 6/1941 | Wread | |
| 2,292,001 | A | | 8/1942 | Wright | 156/17 |
| 2,317,660 | A | * | 4/1943 | Williams | |
| 2,326,454 | A | | 8/1943 | Gentile | 160/236 |
| 2,532,617 | A | * | 12/1950 | Hauser et al | 160/178.3 |
| 2,533,298 | A | * | 12/1950 | Walker | |
| 2,591,750 | A | * | 4/1952 | Walker | |
| 2,669,301 | A | * | 2/1954 | Evans | 160/178.3 |
| 2,796,927 | A | * | 6/1957 | Evans | |
| 3,319,695 | A | | 5/1967 | Houmere | 160/168 |
| 4,928,369 | A | * | 5/1990 | Schnebly et al. | |
| 5,553,653 | A | | 9/1996 | Rozon | 160/173 |
| 5,595,231 | A | | 1/1997 | Marocco | 160/168.1 |
| 5,597,027 | A | | 1/1997 | Simon et al. | 160/168.1 |
| 6,105,652 | A | * | 8/2000 | Judkins | 160/115 |
| 6,179,035 | B1 | * | 1/2001 | Anderson | |

FOREIGN PATENT DOCUMENTS

| | | | |
|---|---|---|---|
| AU | 243263 | * | 8/1960 |
| DE | 2 221 003 | | 11/1973 |
| DE | 38 25 049 | | 12/1988 |
| DE | 29904993 | | 7/1999 |
| DE | 19805272 | | 12/1999 |
| GB | 1165243 | | 9/1969 |
| GB | 2163372 | | 2/1986 |
| IT | 550047 | * | 10/1956 |
| JP | 1-73297 | | 5/1989 |

* cited by examiner

*Primary Examiner*—Blair M. Johnson
(74) *Attorney, Agent, or Firm*—Dorsey & Whitney LLP

(57) ABSTRACT

A covering for an architectural opening in the form of a Venetian blind includes a plurality of supporting ladders for horizontally disposed but vertically spaced slats with the ladders including vertically extending spaced guide cords and interconnecting rungs at vertically spaced locations along the guide cords. The rungs support associated slats in a horizontal orientation and the slats are connected to the rungs so that when the guide cords are shifted vertically relative to each other causing the rungs to tilt, the slats are positively moved between a horizontal disposition and a substantially vertical disposition in which a light blocking seal between the slats is established.

17 Claims, 9 Drawing Sheets

LADDER OPERATED COVERING WITH FIXED VANES FOR ARCHITECTURAL OPENINGS

CROSS REFERENCE TO RELATED APPLICATIONS

This application claims priority to U.S. provisional application No. 60/258,158 filed on Dec. 22, 2000 and to U.S. provisional application No. 60/305,996 filed on Jul. 16, 2001.

BACKGROUND OF THE INVENTION

1. Field of the Invention

The present invention relates generally to coverings for architectural openings and more particularly to a Venetian blind type covering where the slats are fixed to the supporting ladder.

2. Description of the Relevant Art

Coverings for architectural openings have taken numerous forms over many centuries. Initially, fabrics were simply draped across architectural openings such as windows, doorways, archways, and the like. These early crude forms of coverings evolved into pleated draperies, curtains, and the like, which were made out of suitable fabrics for providing the desired aesthetic and utilitarian function desired. Venetian blinds are another popular form of covering for architectural openings wherein a plurality of horizontally disposed slats are supported on tape or cord ladders so as to be movable between an extended position wherein the slats are evenly distributed across the architectural opening and a retracted position wherein they are vertically stacked adjacent to the top of the opening. The slats are also tiltable or pivotable about a longitudinal horizontal axis between open and closed positions with flat surfaces of the slats lying horizontally in the open position defining spaces therebetween and somewhat vertically in the closed position so as to overlap and block vision through the blind. The slats are moved between the open and closed positions by shifting vertical runs of the ladder in opposite directions so as to tilt the rungs which interconnect the vertical runs of the ladder at vertically spaced locations and support the slats.

When tilting slats in conventional Venetian blinds between open and closed positions by tilting the rungs on which the slats are supported, the slats are typically pivoted about a longitudinal horizontal axis through slightly less then 90 degrees so that even though the slats overlap adjacent slats in their closed positions, there are gaps between the slats which permit the passage of light. The slats do not fully pivot through 90 degrees in as much as the lower edge of a slat, as it is being pivoted, is trapped in crotches between vertical runs and associated rungs on which the slats are supported.

In an effort to increase the blockage of light passing through a Venetian blind that has been closed by pivoting the slats into substantially vertical orientations, it would be desirable to more fully pivot the slats through or closely approaching 90 degrees but to date this has not been achievable with the use of conventional tape or cord ladders which have been in use for many years.

Attempts have been made, as evidenced by British specification No. 1,165,243, to better block the passage of light through the slats of a Venetian blind, but such attempts have aesthetic shortcomings. For example, in the system described in the British patent, the holes, which are typically found in the slats of Venetian blinds to accommodate the lift cords, have been removed with the lift cords being interwoven along the vertical runs of the cord ladders. In order to hold the slat in position, tabs are punched in the slats of the vertical blind, which are adapted to clamp the corresponding rungs of a cord ladder to prevent the slat from sliding relative to the cord ladder while permitting it to be removed without removing the lift cords. As will be appreciated, in such a system, the tabs are aesthetically displeasing as they are punched from the main body of the slat and thereby protrude from one surface of the slat and also allow light to pass through the punched hole behind the tab, which is undesirable.

Accordingly, the present invention has been developed to overcome the shortcomings in prior art blinds, shades, and the like, to provide a Venetian blind with improved light blockage when in its closed position, and to provide a new system for lifting blinds or shades at predetermined locations along their length in an aesthetically pleasing manner.

SUMMARY OF THE INVENTION

In accordance with one aspect of the present invention, a conventional ladder for use in a Venetian blind having a pair of vertical runs or guide cords and a plurality of vertically spaced rungs for supporting slats of the Venetian blind further includes an innocuous connector, such as adhesive, on each rung to connect the rung to a surface of an associated slat so that as the rung is tilted by opposite vertical movements of the guide cords, the associated slat is lifted by the rung so as to assume an orientation that is or is very nearly vertical.

Accordingly, when the Venetian blind is extended across an architectural opening and the slats, which have a smooth, hole free and substantially continuous surface, are tilted about their horizontal axes by opposite vertical movements of the guide cords, the slats are shifted from a substantially horizontal open position to a vertical or substantially vertical closed position. The width of each slat is greater than the spacing between adjacent rungs so that when the slats are substantially vertically positioned in the closed position of the blind, they overlap and are biased into engagement with the next adjacent slats to preclude the passage of light through the covering.

It will be appreciated with the description hereafter that the principles of the present invention can also be applied to vertical blinds, shutters, shades, and the like.

Other aspects, features, and details of the present invention can be more completely understood by reference to the following detailed description of the preferred embodiment, taken in conjunction with the drawings and from the appended claims.

DESCRIPTION OF THE PREFERRED EMBODIMENTS

Figure 1:
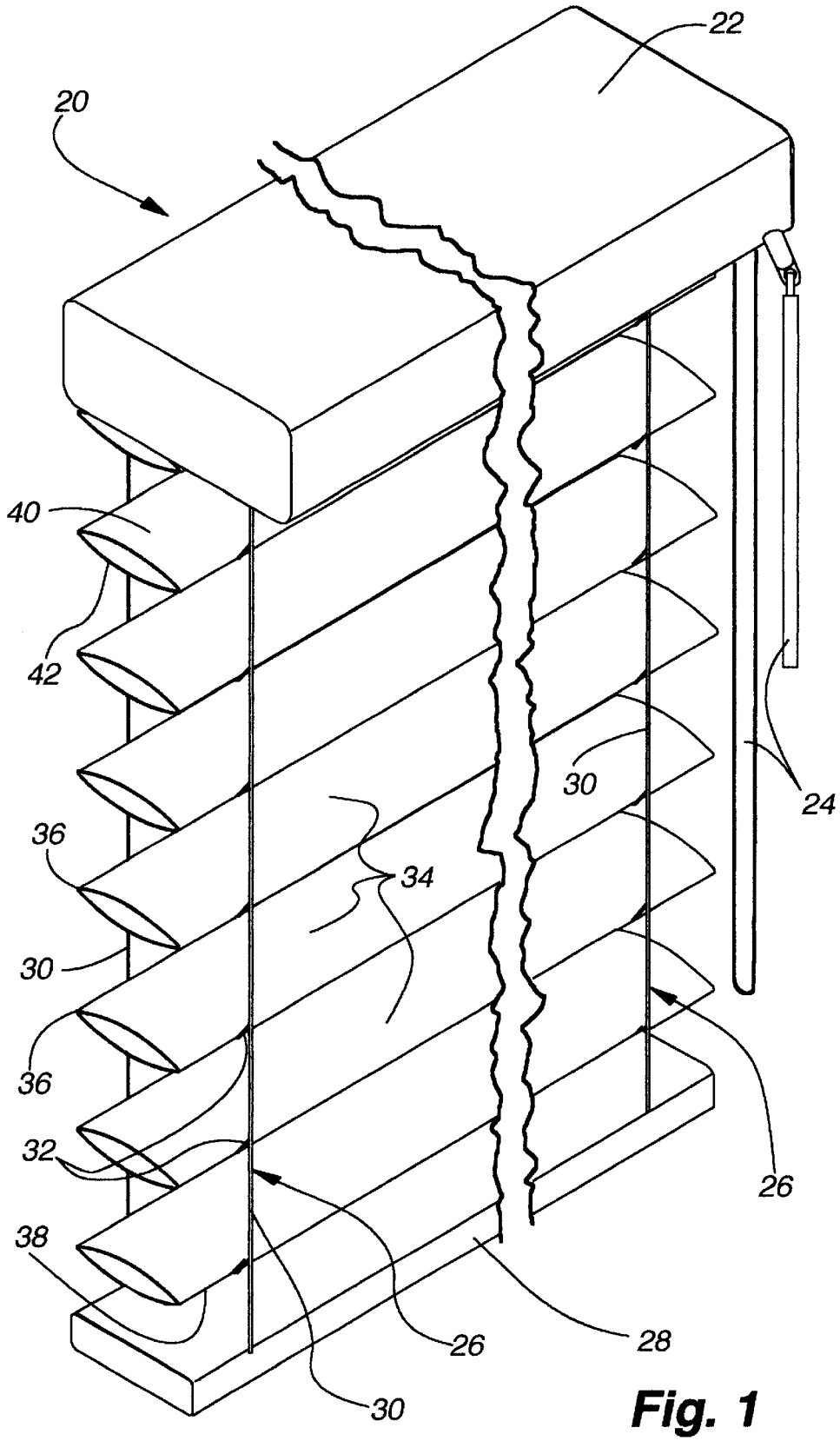
FIG. 1 is a fragmentary isometric view showing a Venetian blind in accordance with the present invention wherein the slats are of a tubular configuration and the blind is in an extended and open position.

An example of a covering 20 for an architectural opening incorporating the present invention is illustrated in FIG. 1 to include a head rail 22 in which conventional operative control elements (not shown) for the covering are confined, a pair of control wands 24 suspended from one end of the head rail for operating the control elements of the covering, a pair of cord ladders 26 suspended from the operative control elements of the system with the ladders supporting a horizontal bottom rail 28 at their lowermost ends, and a lift cord 29 (FIGS. 16 and 17) associated with each ladder extending from the control elements to the bottom rail for moving the covering between extended and retracted positions. Each cord ladder as may best be seen in FIGS. 5–8, includes a pair of vertically spaced runs or guide cords 30 that are interconnected by rungs or cross ladders 32 at equally vertically spaced locations. In the illustrated embodiment, the guide elements and rungs are in the form of cords even though other such flexible elements including tapes and the like could also be used consistently with the present invention. The covering further includes a plurality of vertically spaced horizontally extending or disposed slats 34. While the slats might be smooth, solid, hole free and uninterrupted along their length (e.g., wood) they might also be continuous, hole free and uninterrupted tubular slats such as illustrated in FIG. 1 having a left side edge 36 adjacent one vertical guide cord, a right side edge 38 adjacent the other vertical guide cord, a top surface 40 and a bottom surface 42 with the bottom surfaces being supported on associated rungs 32 of the ladders. As will be appreciated, the covering 20 in accordance with the present invention is very similar to conventional Venetian blinds but as will be described in more detail hereafter, the covering is an improvement over conventional Venetian blinds in that the slats 34 are secured to the supporting rungs 32 of the ladders 26 by connectors so that they are positively moved during operation of the covering. Further, the slats may be, and in the disclosed embodiment are, devoid of any apertures therethrough, as are found in the slats of most Venetian blinds, so that light can be almost totally blocked when the blind is closed.

Figure 2:
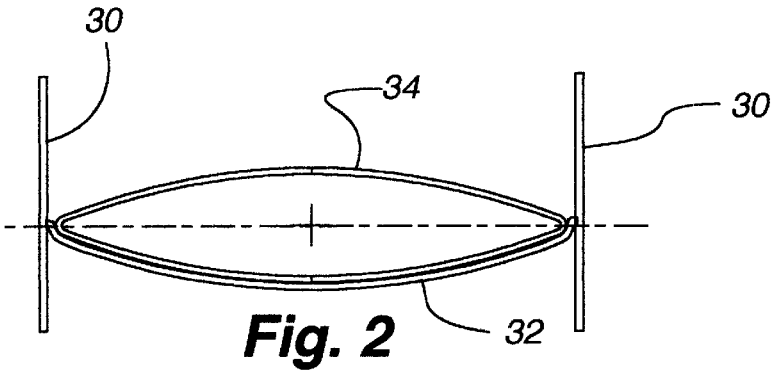
Fig. 2 PRIOR ART
FIG. 2 is a fragmentary end elevation of a prior art system for supporting a tubular vane in a Venetian blind.
Figure 3:
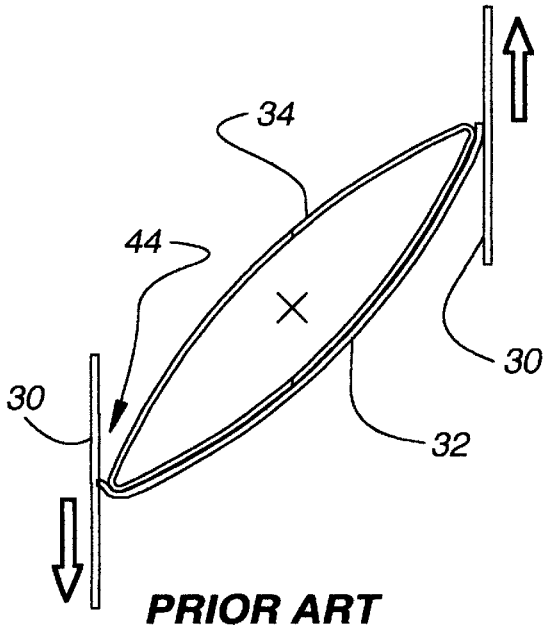
PRIOR ART Fig. 3
FIG. 3 is an end elevation similar to FIG. 2 of a prior art system with the guide cords having been shifted vertically to tilt the rung on which the vane is supported.
Figure 4:
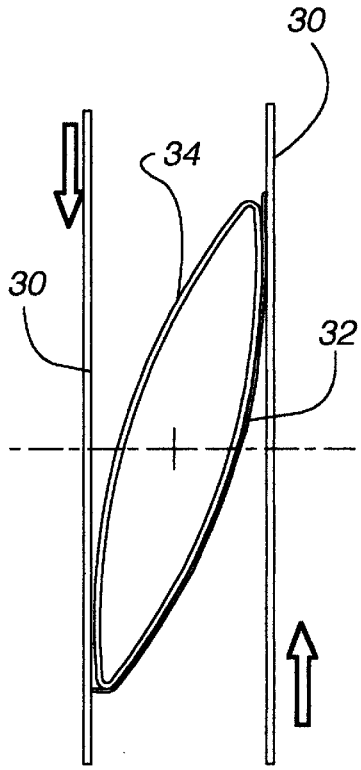
PRIOR ART Fig. 4
FIG. 4 is an end elevation similar to FIG. 3 of a prior art system with the tubular vane in the prior art system having been tilted a maximum amount.

Referencing FIGS. 2–4, a tubular vane or slat 34 incorporated into a conventional prior art Venetian blind is illustrated. The slat is shown supported or cradled on the rung 32 of a cord ladder 26 having guide cords 30 at opposite ends of the rung to which the rung is attached. In FIG. 2 the slat is shown in a horizontal orientation which is the orientation assumed when the covering or Venetian blind is in an open position so that vision and light is permitted between adjacent slats in the blind. FIG. 3 shows an angular position of the slat which it assumes when the right guide cord is moved upwardly and the left guide cord is moved downwardly as indicated with arrows thereby tilting the rung on which the slat is supported. FIG. 4 illustrates the position of the slat when the guide cords have been moved in opposite vertical directions to their extreme and as will be appreciated, a crotch 44 is defined between the left guide cord and the rung at the location where the rung is attached to the left guide cord. The left side edge 36 of the slat is confined in the crotch 44 which forces it into the angled position illustrated. In other words, when the slat is rotated to its maximum degree, it is not vertically oriented but rather forms an acute angle with vertical. While not being illustrated, it is understood that slats in a Venetian blind are typically wider from side edge to side edge than the vertical spacing between the rungs 32 on which they are supported so that they overlap vertically to block vision through the blind when the blind is in a closed position as illustrated in FIG. 4. Due to the fact that the slats do not assume a vertical orientation, however, the slats will typically not engage each other so that light is permitted between adjacent slats even in the closed position of the blind.

The covering or blind 20 of the present invention has been designed to overcome the shortcomings in prior art Venetian blinds and does so by attaching or securing the slats 34 in the blind to the rungs 32 on which they are supported in an innocuous manner. With reference to FIGS. 5–8, it will be seen that the tubular slat 34 utilized in the blind is cradled or supported by the rung of a cord ladder 26 that includes horizontally spaced but vertically extending guide cords 30 that are interconnected by the rungs at equal vertically spaced locations.

Figure 5:
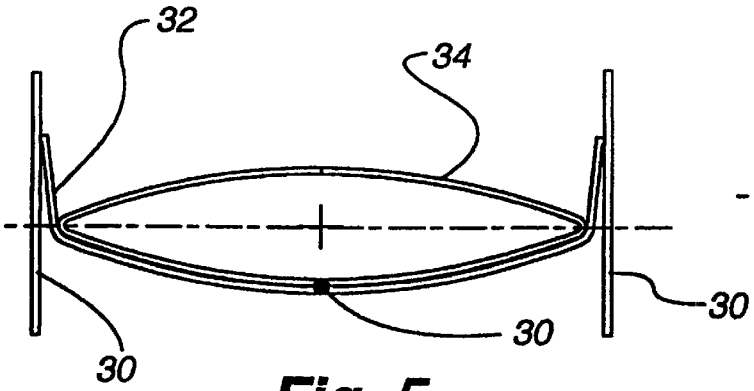
FIG. 5 is a fragmentary end elevation of a tubular vane supported on a ladder including a connector for securing the vane to the ladder in accordance with the present invention.
Figure 15:
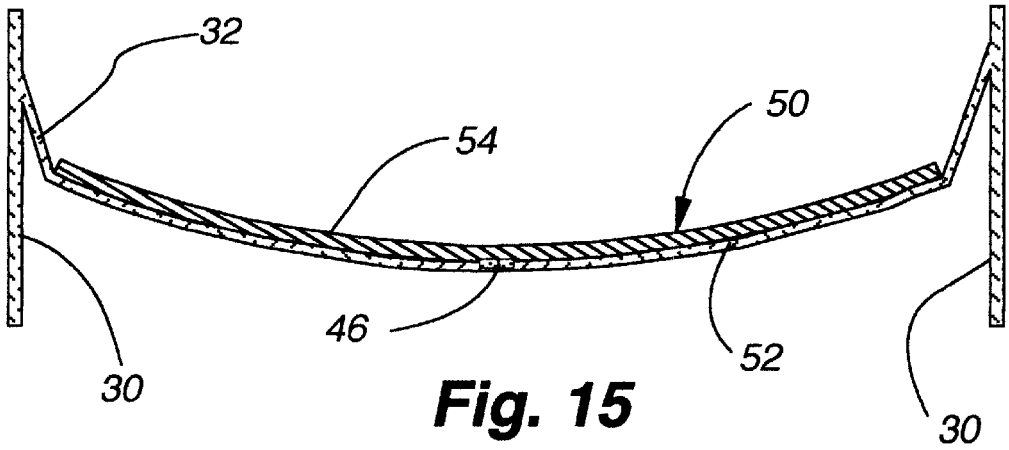
FIG. 15 is an end elevation similar to FIG. 14 showing still another embodiment wherein the vanes are arcuate rather than flat or tubular.
Figure 14:
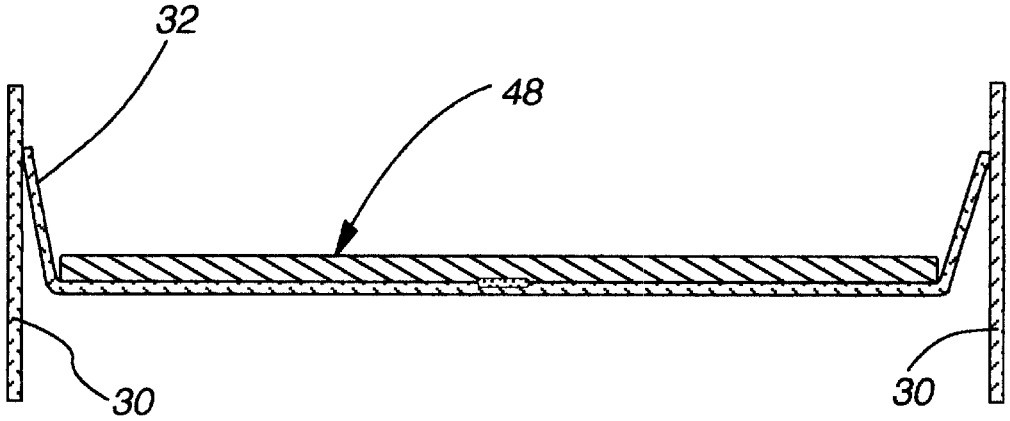
FIG. 14 is an end elevation of a second embodiment of the present invention wherein the slats of the Venetian blind are flat rather than tubular.

Typically, the length of the rungs 32 is greater than the width of the slats as can be clearly seen in FIGS. 5–8. In general, for reasons that will become clear in the description below, the cross rung 32 is desirably longer than the width of the slat by at least the maximum thickness of the slat when tubular slats 34 of the illustrated configuration are utilized. In the case of wood blind slats, which have a rectangular configuration, the rungs are desirably longer than the width of the wood slat by at least two times the thickness of the slat. It is further noted that the extra length of the rungs be equally distributed on either side of the slat as can be seen, for instance, in FIG. 5. In other words, the slat is centered in the rung relative to the rung's length. In the arrangement illustrated in FIGS. 5–8, the slat is secured to the rung by a connector 46 at a location that is intermediate the side edges 36 and 38 of the slat. Additionally in the preferred embodiments, as shown in FIGS. 5, 14, and 15, the spacing of the guide cords 30 of the cord ladders 26 is greater than the width of an associated slat 34 cradled therein. Preferably, the spacing of the guide cords is greater than the width of the slat 34 plus the thickness of the slat. It can be appreciated that the extra length of the cross rungs in excess of the width of the slats permits the portion of the cross rung located below the connection location to remain slack as it is pivoted into the closed position (see FIG. 7). If the length of the rung is too short, then when the slat is rotated into the closed position the lower portion of the cross rung 32 may become taught, thereby preventing the slat 34 from being capable of rotating over center to the preferred position in contact with both upper and lower adjacent slats.

The location that the slat is attached to the rung by the connector 46 is not critical so long as a lever arm exists between the slat's transverse center of gravity (as viewed in the transverse cross section of the slat as shown, for example, in FIG. 5) and the connection location. The weight of the slat acting through the transverse center of gravity will cause the top of the slat to be urged over center about the connection location upon closing. It can be appreciated, therefore, that the connection location may be anywhere on the bottom surface of a wood-style slat and almost anywhere except the very edges of a tubular slat 34 as illustrated. For example, the connection location could be located in-between the transverse midpoint of the bottom surface and one edge of the slat. In certain embodiments, the slat can be secured to a rung by more than one connector 46 at two or more connection locations on the rung. The use of two connectors for rungs located very close to the ends of the slats have been found to help prevent a section of the rung from sliding out from under the slat. It can also be appreciated that the connection locations could be placed on the top surfaces of the slats, whereby the slats are suspended from their associated rung. Of particular note, the connection location is preferably not placed on the concave side of a typical aluminum Venetian blind slat, such as illustrated in FIG. 15, but rather on the convex side proximate the slat's center to ensure a proper lever arm is formed with the transverse center of gravity that will pull the aluminum slat's top end over center when closed.

The connector 46 is preferably in the form of a bead of adhesive, which might be by way of example a hot melt or thermoset adhesive, that is either clear or matches the color of the slat so that it is innocuous, i.e., substantially invisible and does not visually disrupt the smooth continuous surface of the slat.

Figure 7:
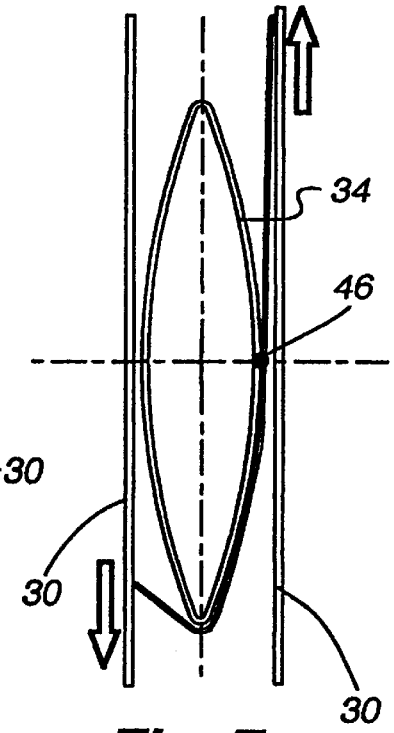
FIG. 7 is an end elevation similar to FIG. 5 showing the vane having been tilted 90 degrees through vertical movement of the guide cords.
Figure 6:
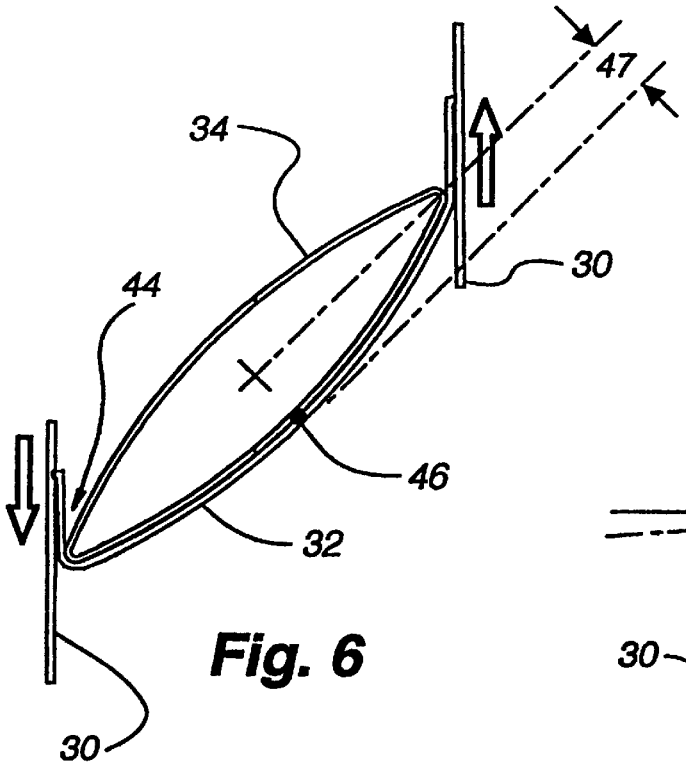
FIG. 6 is an end elevation similar to FIG. 5 with the guide cords of the ladder having been shifted in opposite directions to tilt the rung on which the vane is supported.

Referencing FIG. 6, the guide cords 30 supporting a single slat 34 have been shifted in opposite directions causing the rung to be tilted with the slat following the inclination of the rung on which it is supported while being positively affixed thereto. In FIG. 7, the guide cords have been moved in opposite directions a maximum amount and as will be appreciated, the slat has been moved with its connected rung so that it assumes a vertical orientation with the longitudinal edges 36 and 38 of the slat being vertically aligned. The lower or left longitudinal edge 36 of the slat has not been allowed to be confined within the crotch 44, as in prior art systems, but rather has been pulled to a centered position between the guide cords so that the slat is vertically positioned on its edge.

Figure 8:
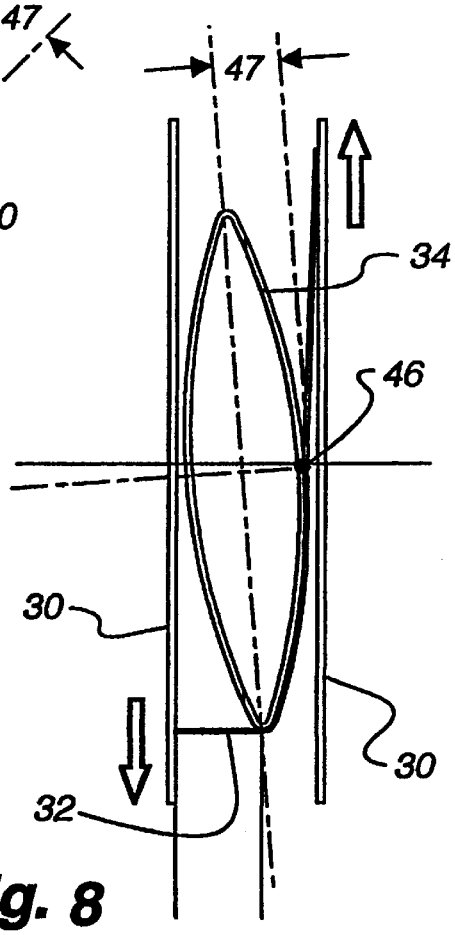
FIG. 8 is an end elevation similar to FIG. 7 showing the vane having shifted due to gravity beyond the vertical orientation shown in FIG. 7.

FIG. 8 illustrates a bias in the slat once it has been moved to the vertical orientation of FIG. 7 with the bias causing the top of the slat (when unobstructed) to actually pivot over center in a counter clockwise direction due to the transverse center of gravity of the slat located at the "x" location (as seen in FIG. 6) being spaced from the connector 46 to form a lever arm 47.

Figure 18:
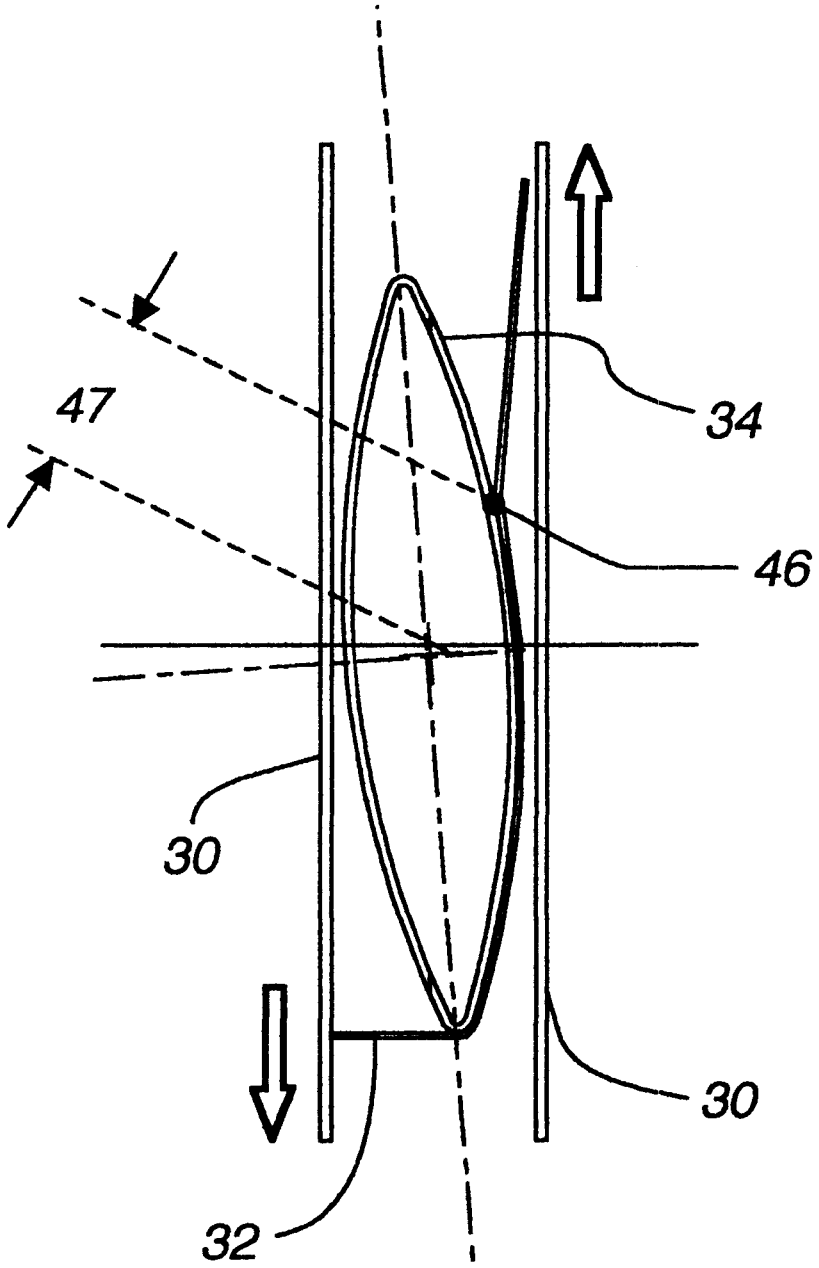
FIG. 18 is an end elevation similar to FIG. 8 except the vane is secured to the cross rung at a location closer to one of the vane's edges.

As will be appreciated, if the connector location 46 is located off of the longitudinal center in the width direction of the slat as shown in FIG. 18, the slat will also be encouraged to move to a vertical orientation and preferably beyond. The lever arm 47 formed by the greater distance between the center of gravity and connection location causes the slat to essentially rotate about the connection location, for instance, in a counter-clockwise direction as shown in FIG. 18. In a Venetian blind covering application, this bias is arrested when the top or bottom of the slat impacts the top or bottom of another adjacent slat.

Figure 12:
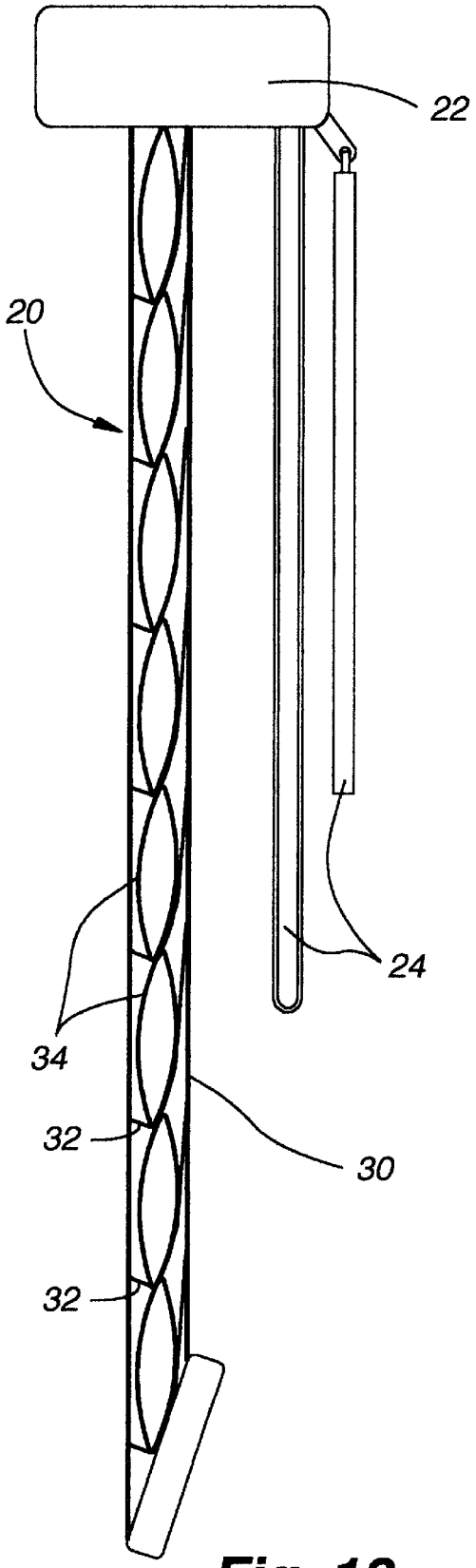
FIG. 12 is an end elevation of a Venetian blind in accordance with the present invention wherein the blind is in an extended but closed position with each vane engaging the next adjacent vane.
Figure 13:
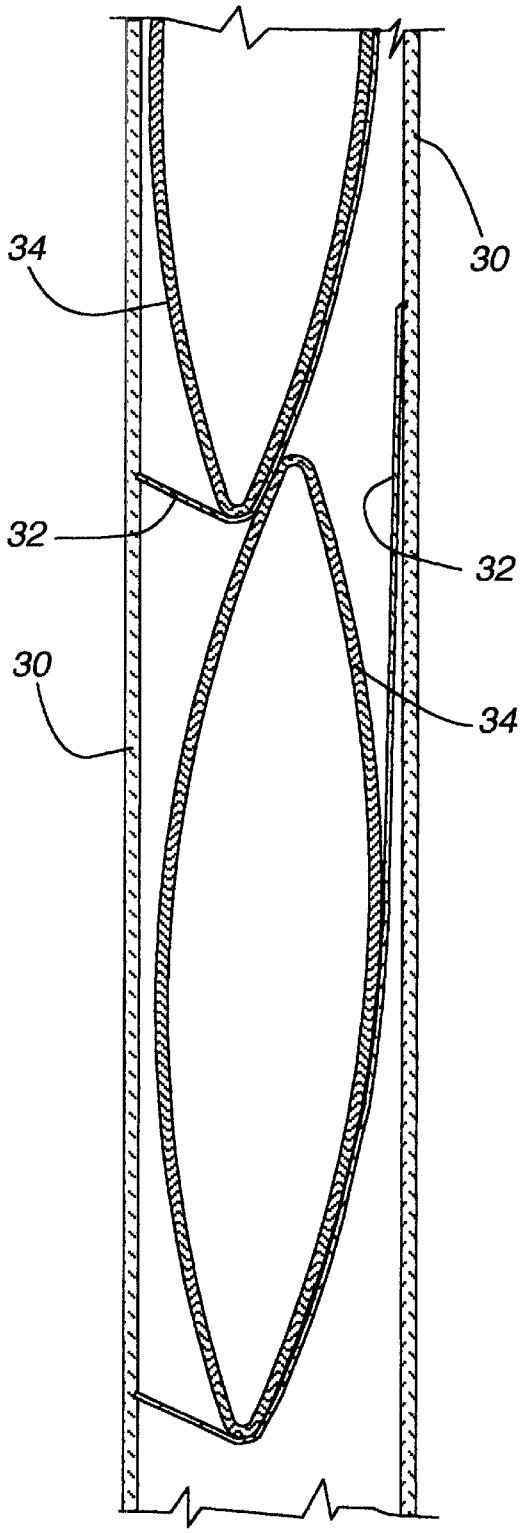
FIG. 13 is an enlarged fragmentary vertical section taken through the Venetian blind of the present invention better illustrating the engaged relationship of adjacent vanes.

The bias of the vane urging it over center is effective in establishing a light blocking seal between adjacent vanes as can be appreciated with reference to FIGS. 12 and 13. When there are a plurality of vanes 34 there is interference between the vanes along their edges when in their closed position and the interference may prevent the vanes from being perfectly vertically oriented but the center of gravity of each vane urges the vane toward a position that is over center so that it leans against and engages the next adjacent vane at the top and bottom edges to establish a light blocking seal between adjacent vanes. As discussed above in reference to FIGS. 2–4, the movement of prior art vanes towards a vertical orientation is arrested due to the cross rung's crouch 44 before it can contact the adjacent vanes.

Figure 9:
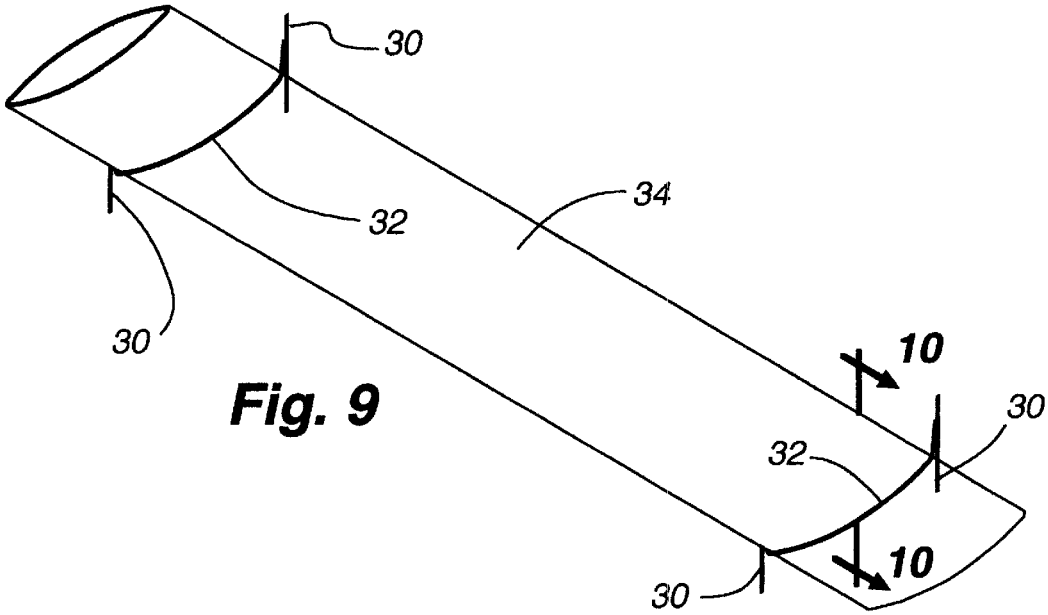
FIG. 9 is a fragmentary isometric view looking upwardly at the bottom of a vane supported on a pair of ladders in accordance with the present invention.
Figure 10:
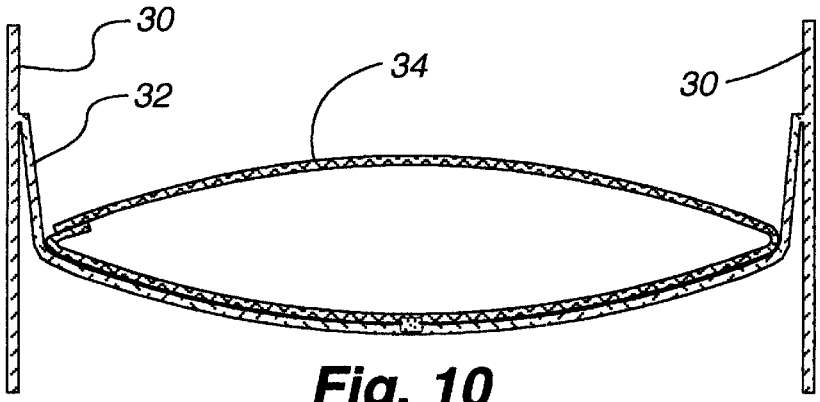
FIG. 10 is an enlarged section taken along line 10—10 of FIG. 9.
Figure 11:
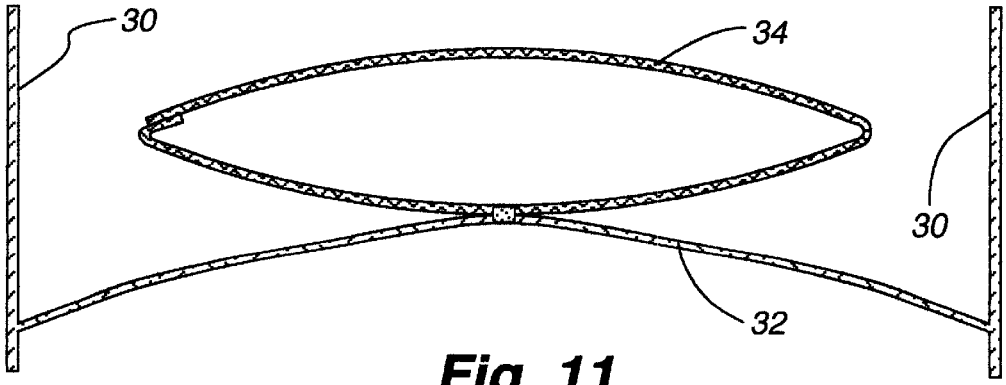
FIG. 11 is a section similar to FIG. 10 showing the guide cords having been spread apart and the vane artificially lifted relative to the rung on which it is supported.

The interrelationship between the cord ladders 26 and the slats 34 is possibly best illustrated in FIGS. 9–11 with FIG. 9 illustrating the supporting relationship between a slat and the associated rungs 32 of adjacent cord ladders, FIG. 10 showing the attachment of the slat to an associated rung and FIG. 11 showing the slat artificially raised relative to its underlying rung to show the connection thereof at an intermediate location between the longitudinal edges of the slat.

It is to be appreciated that it is preferable to center the slat on the rung especially if the rungs are no longer than the general minimum distances discussed above. If the rung is not long enough relative to the width of the slat, the tension applied by the rung as it is pulled taut when the slat is moved towards its vertical orientation can be enough to prevent the slat from reaching it vertical orientation so that its top end can be pulled over center as described in a preceding paragraph.

While the slats have been illustrated as being supported along their bottom surface 42 on an associated rung, it will be appreciated that other arrangements (not shown) could be employed such as securing the top surface 40 of the slat to a rung so that the slat was suspended from the rung. In such an arrangement, the position of the slat would again be positively controlled by movement of the rung so that the slats could be moved into substantially vertical orientations for engagement with adjacent slats in establishing a light blocking seal between adjacent slats.

While the slats in the aforedescribed embodiment of the present invention have been illustrated as being tubular in configuration with convex top 40 and bottom 42 surfaces or walls, the slats could in fact be flat, smooth slats 48 having flat top and bottom surfaces as illustrated in FIG. 14 or smooth arcuate slats 50 (such as a typical aluminum Venetian slat) having a concave top wall 54 and a convex bottom wall 52 as illustrated in FIG. 15. In order to create the proper lever arm, the connection location for the aluminum slat should be on the convex side of the slat as shown.

Another important feature of the present invention resides in the fact that the slats can be positively connected to the ladders for controlled movement without the need of holes or other apertures through the slats which are typically found in slats of Venetian blinds for receiving lift cords. Lift cords typically extend from the control system in the headrail downwardly through aligned holes in the slats for connection to the bottom rail. By raising the lift cords, the bottom rail is drawn toward the head rail thereby accumulating and vertically stacking the slats therebetween. The Venetian blind is thereby movable between a retracted position where the bottom rail is positioned adjacent to the head rail with the slats stacked therebetween and an extended position where the bottom rail has been allowed to drop by gravity from the head rail thereby evenly distributing the slats across the architectural opening. A disadvantage with conventional Venetian blinds where holes in the slats are provided to accommodate the lift cords resides in the fact that even when the slats are tilted into their substantially vertical orientation and the window covering is closed, light is still allowed to pass through the holes in the slats which receive the lift cords.

Figure 16:
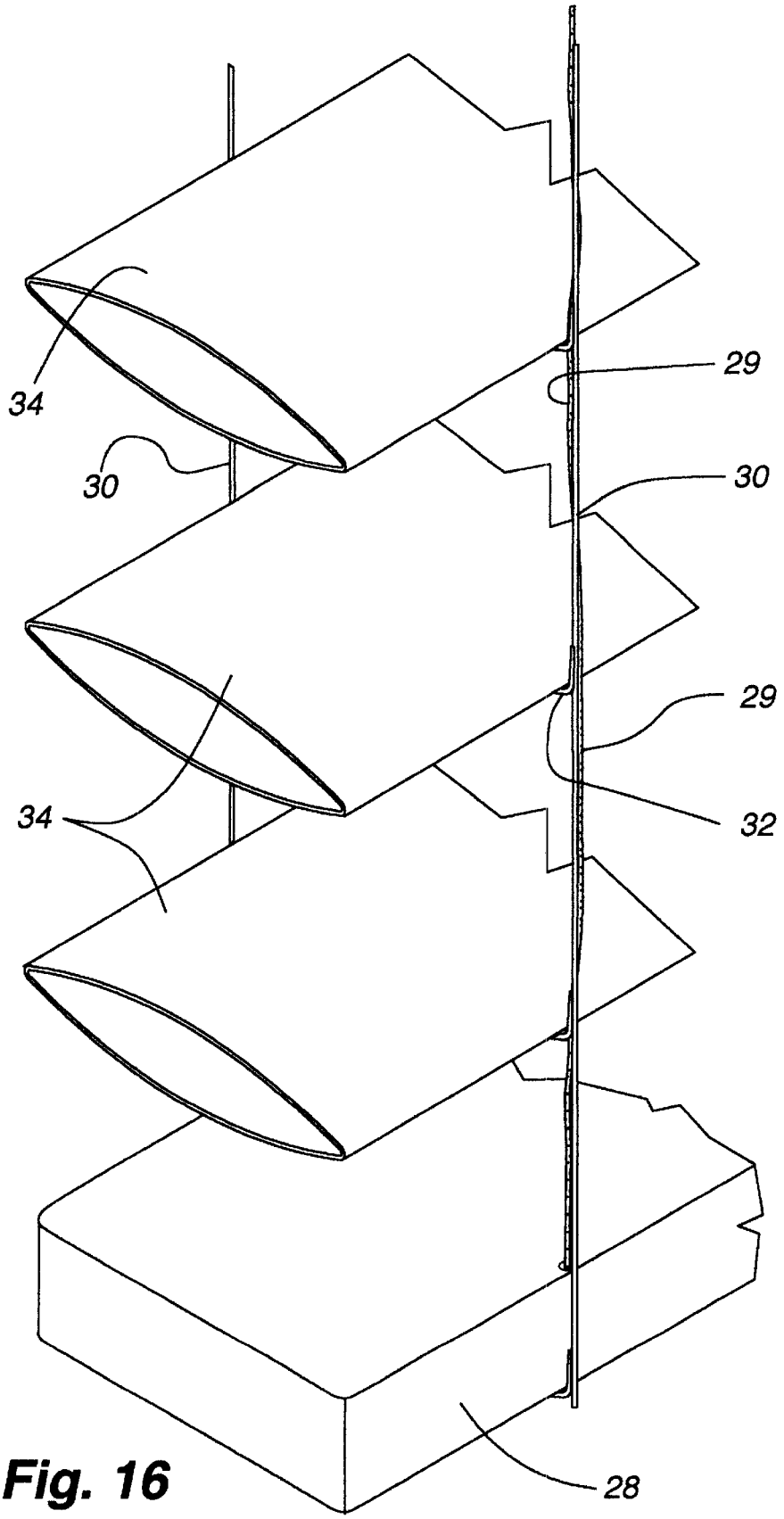
FIG. 16 is a fragmentary isometric looking downwardly on a Venetian blind incorporating the present invention showing a lift cord for the blind interwoven in a vertical guide cord.
Figure 17:
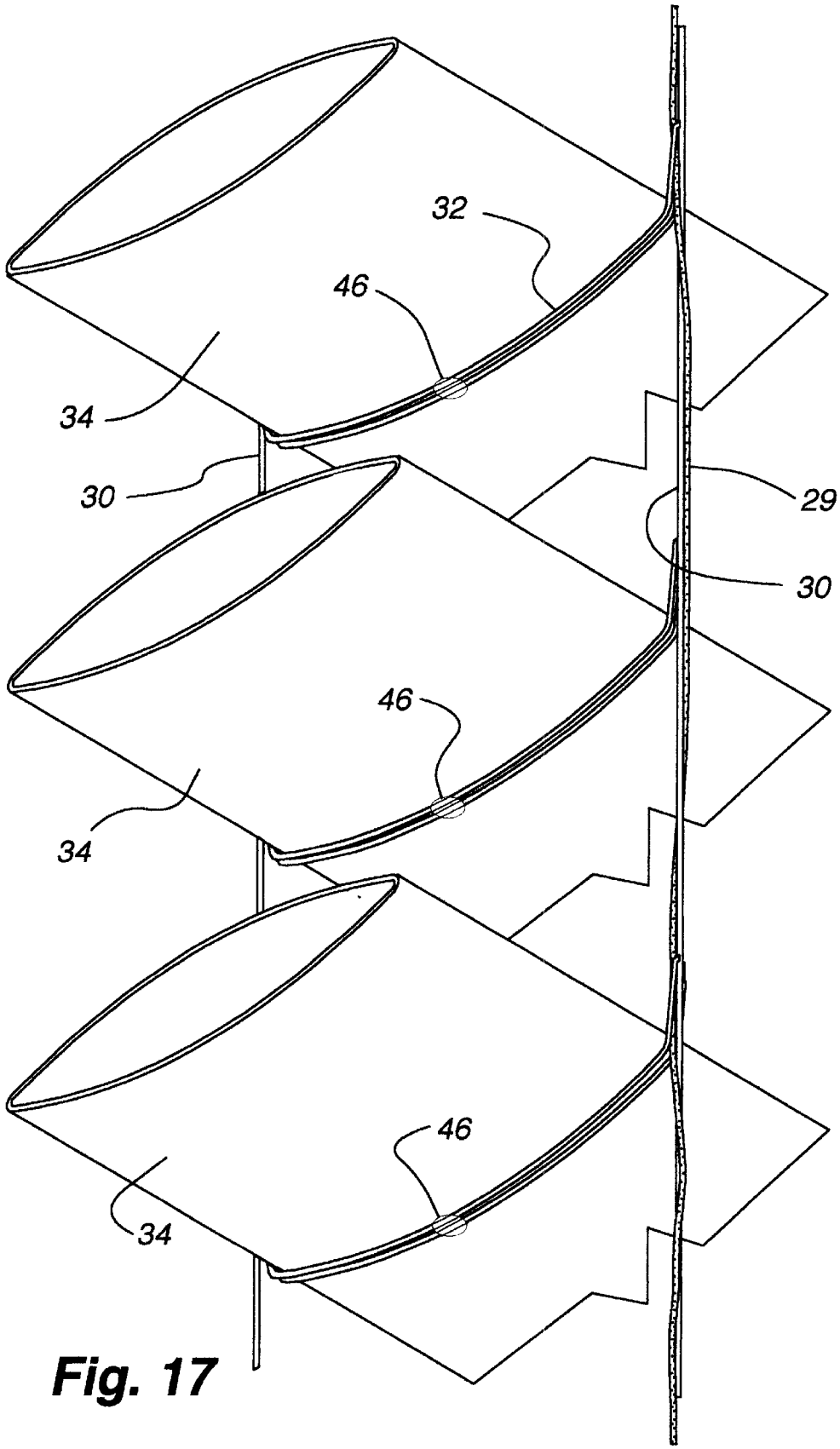
FIG. 17 is a fragmentary isometric similar to FIG. 16 looking upwardly at the Venetian blind.

In the present invention as illustrated in FIGS. 16 & 17, the lift cords 29 preferably extend downwardly adjacent to or are interlaced with one of the guide cords 30 and then are interwoven through selected rungs 32 of the ladder which hold the lift cords in position. Desirably, the rungs of the ladder consist of at least two strands that together support the slat. The lift cords can be strung between the strands of a rung 32 as it meanders downwardly adjacent to a guide cord for connection to the bottom rail 28. Desirably, one of the lift cords 29 extends along a guide cord on the front of the Venetian blind while an adjacent lift cord on an adjacent ladder extends along the guide cord on the rear of the Venetian blind so that when the bottom rail is lifted with the lift cords, it is lifted evenly.

It will be appreciated from the above that a Venetian blind has been described which positively controls the positioning of the slats in the blind so that they can be moved into a light blocking sealed relationship when the blind is moved into a closed position. Further, it will be appreciated that the slats are always maintained uniformly relative to each other due to the positive connection of the slats to the associated rungs which is an improvement over conventional Venetian blinds wherein the slats are merely placed loosely on the rungs and therefore many times assume different angular positions relative to each other which is aesthetically displeasing to the eye and a nuisance to an operator of the blind. The slats are also smooth, continuous, uninterrupted and can be hole-free so that they totally block the passage of light when the blind is closed.

The tubular slats as illustrated herein are described in greater detail in a co-pending provisional application entitled, "Tubular Slat For Coverings For Architectural Openings", filed on Jul. 18, 2000 (U.S. Patent Office application No. 60/219,039), Venetian blinds incorporating embodiments of the present invention are described in greater detail in co-pending and concurrently filed provisional application entitled "Shutter Type Covering For Architectural Opening" (U.S. Patent Office application No. 60/305,947) to which priority is claimed and which are incorporated by reference in their entirety herein.

Although the present invention has been described with a certain degree of particularity, it is understood that the present disclosure has been made by way of example, and changes in detail or structure may be made without departing from the spirit of the invention as defined in the appended claims.

What is claimed is:

1. A covering for an architectural opening movable between open and closed positions comprising in combination:

at least two cord ladders including vertically extending spaced elongated guide members which have a maximum spacing when the covering is in an open position and a plurality of elongated rungs interconnecting the guide members at longitudinally spaced locations;

a control system for manipulating the ladders;

at least one tubular substantially horizontally disposed slat having a predetermined width and thickness, and wherein the length of a rung is longer than the width of the slat by at least the thickness of the slat, said slat having top and bottom surfaces and being supported on a rung of each ladder, and a connector system for securing one of said top and bottom surfaces of said slat to a rung on which it is supported.

2. A covering for an architectural opening movable between open and closed positions comprising in combination:

at least two cord ladders including vertically extending spaced elongated guide members which have a maximum spacing when the covering is in an open position and a plurality of elongated rungs interconnecting the guide members at longitudinally spaced locations;

a control system for manipulating the ladders;

at least one slat substantially horizontally disposed slat having a predetermined width and thickness, and wherein the length of a rung is longer than the width of the slat by at least twice the thickness of the slat, said slat having top and bottom surfaces and being supported on a rung of each ladder, and a connector system for securing one of said top and bottom surfaces of said slat to a rung on which it is supported.

3. A covering for an architectural opening movable between open and closed positions comprising in combination:

at least two cord ladders including vertically extending spaced elongated guide members which have a maximum spacing when the covering is in an open position and a plurality of elongated rungs interconnecting the guide members at longitudinally spaced locations;

a control system for manipulating the ladders;

at least one tubular substantially horizontally disposed slat having a predetermined width and thickness, and wherein the maximum spacing of the guide cords is greater than the width of the slat plus the thickness of the slat, said slat having top and bottom surfaces and being supported on a rung of each ladder, and a connector system for securing one of said top and bottom surfaces of said slat to a rung on which it is supported.

4. A covering for an architectural opening movable between open and closed positions comprising in combination:

at least two cord ladders including spaced vertically extending elongated guide members and a plurality of rungs interconnecting the guide members at vertically spaced locations;

a control system for manipulating the ladders so as to simultaneously shift the guide members in opposite longitudinal directions thereby tilting the rungs;

at least one substantially horizontally disposed slat having longitudinal edges and top and bottom surfaces and being supported on a rung of each ladder, said longitudinal edges being positionable adjacent to said guide members when said rungs are disposed substantially horizontally in the open position of the covering and a lower one of said longitudinal edges being substantially centered between said guide members when the rungs on which it is supported are maximally tilted in the closed position of the covering causing the slat to also be tilted, a connector system for securing one of said top and bottom surfaces of said slat to a rung on which it is supported.

5. A covering for an architectural opening comprising:

one or more ladder members, each of the one or more ladder members including a pair of spaced vertically-extending elongated guide members and at least one rung extending between and interconnected with each guide member of the pair of guide members, each rung of the at least one rung having a rung length;

a plurality of substantially horizontally disposed slats, each slat having top and bottom surfaces and opposing front and rear longitudinal edges, the top and bottom surfaces of each slat being secured to at least one rung of the one or more ladder members at an attachment location which is located closer to one of the front and rear longitudinal edges than to the other of the front and rear longitudinal edges; and a head rail from which the one or more ladder members depend.

6. A covering for an architectural opening comprising:

one or more ladder members, each of the one or more ladder members including a pair of spaced vertically-extending elongated guide members and at least one rung extending between and interconnected with each guide member of the pair of guide members, each rung of the at least one rung having a rung length;

a plurality of substantially horizontally disposed slats, each slat having top and bottom surfaces and opposing front and rear longitudinal edges, one of the top and bottom surfaces of each slat being secured to at least one rung of the one or more ladder members at an attachment location in between the front and rear longitudinal edges, each of said slats having a transverse center of gravity and wherein the attachment location is located a distance from the transverse center of gravity; and a head rail from which the one or more ladder members depend.

7. A covering for an architectural opening comprising:

one or more ladder members, each of the one or more ladder members including a pair of spaced vertically-extending elongated guide members and at least one rung extending between and interconnected with each guide member of the pair of guide members, a plurality of substantially horizontally disposed imperforate slats, each slat having top and bottom surfaces and opposing front and rear longitudinal edges, only one of the top and bottom surfaces of each slat being secured to and engaged with at least one rung of the one or more ladder members at an attachment location between the front and rear longitudinal edges and each slat being independent of the other slats except through their interconnection with the one or more ladder members, and a head rail from which the one or more ladder members depend.

8. The covering of claim 3 or 4 wherein said top and bottom surface of said slat are flat.

9. The covering of claim 1, 2 or 3 wherein said top and bottom surfaces of said slat are arcuate.

10. The covering of claim 1 wherein both of said top and bottom surfaces are convex.

11. The covering of claim 3 wherein one of said top and bottom surfaces is convex and the other is concave.

12. The covering of claim 1, 2, or 3 wherein said bottom surface of said slat is secured to the rung on which it is supported.

13. The covering of claim 2 wherein said slats are wooden.

14. The covering of claim 1, 2, 3 or 4 wherein said connector system is an adhesive.

15. The covering of claim 14 wherein said adhesive is in the form of a bead of adhesive.

16. The covering of claim 14 wherein said adhesive is clear.

17. The covering of claim 14 wherein said adhesive is colored to match the color of the slats.

* * * * *

UNITED STATES PATENT AND TRADEMARK OFFICE

CERTIFICATE OF CORRECTION

PATENT NO. : 6,662,851 B2
DATED : December 16, 2003
INVENTOR(S) : Wendell B. Colson It is certified that error appears in the above-identified patent and that said Letters Patent is hereby corrected as shown below:

Column 8,
Lines 18 and 54, after “and”, first occurrence, insert -- maximum --;
Line 20, after “the”, second occurrence, insert -- maximum --;
Line 32, after “elongated” insert -- flexible --;
Line 35, delete “slat”, first occurrence;
Line 41, after “securing” insert -- only --; and
Line 56, after “the”, third occurrence, insert -- maximum --.

Column 9,
Lines 12 and 13, delete “substantially centered between” and insert -- spaced from --;
Line 28, after “disposed” insert -- imperforate --;
Line 30, after “edges,” insert -- only one of --;
Line 31, after “to” insert -- and in engagement with --;
Line 35, after “edges” insert -- , said slats being independent of each other except through their interconnection with the one or more ladder members --;
Line 45, after “disposed” insert -- imperforate --;
Line 47, after “edges,” insert -- only --; and
Line 48, after “to” insert -- and in engagement with --.

Column 10,
Line 5, after “gravity” insert -- , said slats being independent of each other except through their interconnection with the one or more ladder members --.

Signed and Sealed this

First Day of June, 2004

JON W. DUDAS
*Acting Director of the United States Patent and Trademark Office*